US006648055B1

(12) United States Patent
Haug et al.

(10) Patent No.: US 6,648,055 B1
(45) Date of Patent: Nov. 18, 2003

(54) CASTING TOOL AND METHOD OF PRODUCING A COMPONENT

(75) Inventors: Tilman Haug, Weissenhorn (DE); Steffen Rauscher, Gärtringen (DE); Kolja Rebstock, Ulm (DE); Michaael Scheydecker, Nersingen (DE); Markus Walters, Sindelfingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/958,947

(22) PCT Filed: Apr. 1, 2000

(86) PCT No.: PCT/EP00/02935

§ 371 (c)(1),
(2), (4) Date: Feb. 13, 2002

(87) PCT Pub. No.: WO00/62959

PCT Pub. Date: Oct. 26, 2000

(30) Foreign Application Priority Data

Apr. 16, 1999 (DE) ..... 199 17 175

(51) Int. Cl.[7] ..... B22D 19/08; B22D 17/10
(52) U.S. Cl. ..... 164/98; 164/113; 164/312
(58) Field of Search ..... 164/98, 342, 113, 164/312, 133

(56) References Cited

U.S. PATENT DOCUMENTS 5,947,094 A * 9/1999 Atmur et al. ..... 123/668
6,250,368 B1 * 6/2001 Ushio et al. ..... 164/312

FOREIGN PATENT DOCUMENTS

| | | |
|---|---|---|
| DE | 3411705 | 5/1985 |
| DE | 3444214 | 6/1985 |
| DE | 19710671 | 9/1998 |
| JP | 59147769 | 8/1984 |
| JP | 60130460 | 7/1985 |
| JP | 60213350 | 10/1985 |

OTHER PUBLICATIONS

Copy of International Search Report.

* cited by examiner

*Primary Examiner*—M. Alexandra Elve
*Assistant Examiner*—Len Tran
(74) *Attorney, Agent, or Firm*—Crowell & Moring LLP

(57) ABSTRACT

A die provided for fixing a porous ceramic insert for producing a light metal component which is reinforced by the insert. For this purpose, the insert is positioned in the die in such a way that any force which occurs for the purpose of fixing the insert is compensated for by a collinear force, which minimizes the bending moments exerted on the insert. Furthermore, shielding elements are used to protect the insert from a casting metal flowing into the die. Furthermore, the invention describes a process in which the velocity of a casting plunger which moves the casting metal into the die is regulated in such a way that the insert is not damaged by the kinetic energy of the casting metal. This is achieved by filling the die at a low velocity until the metal has flowed around the insert. Then, the casting plunger is accelerated, thus ensuring optimum filling of the die with the casting metal.

43 Claims, 8 Drawing Sheets

CASTING TOOL AND METHOD OF PRODUCING A COMPONENT

BACKGROUND AND SUMMARY OF THE INVENTION

The present invention relates to a die and to a process for producing a component which is locally reinforced by a porous ceramic insert.

To reduce the component mass, efforts are currently being made to produce relatively large individual components from light metals, for example from aluminum or magnesium, using the pressure die-casting process. This applies in particular to the automotive industry, in which the gear casing and the engine block of motor vehicles are increasingly being manufactured from light metals. However, when using light metals the strength, the resistance to creep and the wear resistance of mechanically loaded partial areas of the components are unsatisfactory in particular in areas which are subject to relatively high temperatures. Consequently, the mechanical load-bearing capacity of light metal components of this type is limited.

A process of the generic type is known from German Patent Document DE 197 10 671 C2. This document discloses a process in which a porous sacrificial body made from a ceramic material (insert) is placed in a defined position in a die and is infiltrated with a molten metal (casting metal) under pressure. The infiltration of the insert with the casting metal leads to the formation of a metal-ceramic composite material (reinforcing element) at the location of the insert. Then, the cast component is heated, so that a reaction takes place between the ceramic material and the casting metal within the reinforcing element, resulting in a composite material comprising ceramic and intermetallic material phases which is superior even to the reinforcing element in terms of its resistance to wear and its strength. However, particularly in the case of local reinforcements, the heating of the component can only be achieved with high technical outlay and high manufacturing costs. Furthermore, process conditions mean that bending stresses may cause damage to the insert during the infiltration.

Japanese Patent Document JP 60130460 A describes a process for producing a composite component which is produced using the centrifugal casting process. A core made from ceramic fibers is placed into a centrifugal die and is supported by holding elements. The holding elements divert the flow of a casting metal past the core, so that after solidification a tube of layered structure is formed, including the core of ceramic fibers and comprising metal at the surfaces. However, a process of this type is not suitable for the infiltration of porous ceramic inserts, since there is not sufficient pressure acting on the insert.

Therefore, the object of the present invention is to provide a die and a further improved process of the above type, so that it is possible to produce light metal components with an improved mechanical load-bearing capacity, in particular an improved resistance to creep, easily and at low cost.

The solution to the object consists in a device (die) having fixing elements for positioning an insert allowing forces which act on the insert to be compensated for by corresponding collinear forces and shielding elements by which the insert is shielded from a principle propagation flow of a casting metal during a casting operation and a process for producing a component with a local reinforcing element made from a metal-ceramic composite material comprising producing a porous ceramic insert from ceramic precursor products; locally positioning the insert in a die which has a runner, a gate, and an impression; filling the die with a casting metal by way of a casting plunger and simultaneously infiltrating the insert at elevated pressure in order to form the local reinforcing element, wherein a preliminary section comprises the filling of the runner and the filling of at least 10% of the impression with the casting metal and wherein a velocity of the casting plunger during the preliminary section is lower than during a filling movement.

The device according to the invention, as described in a preferred embodiment, is distinguished by the fact that, in the die, there are fixing elements which position the insert in a defined way. The fixing elements are designed in such a way that the bending moments which act on the insert are minimized. According to the invention, this is achieved by the fact that forces which act on the insert are compensated for by collinear forces by means of the fixing elements. This means that the force lines of opposite forces lie on a straight line. In addition to the fixing elements according to the invention, the insert is positioned in an impression in such a way that it does not lie directly in the propagation flow of a casting metal. To achieve this, shielding elements are used. Ideally, these shielding elements are components of the impression contour, such as for example edges or walls, which are predetermined by the component geometry. However, it is also possible to design additional fixing elements in such a way that they shield the flow of the casting metal with respect to the insert. Together, the fixing elements and the shielding elements prevent damage to the ceramic insert and thereby reduce the scrap rate in series production of reinforced light metal components.

The insert is preferably positioned in a side of the die which is fixed with respect to a casting machine, since this means that it does not undergo any movement when the die is being closed, which could cause its position to shift. If the geometry of the component and/or the geometry of the die require, it is possible for the insert to be positioned in a moveable side of the die or on a slide. Furthermore, it is possible to position a plurality of inserts in the die, and these inserts may be located in the fixed side and/or the moveable side and/or on a slide.

To minimize the bending moments which act on the insert, it is useful for the insert to be positioned on a wall of the impression. In this case, it is important for the insert to fill up the surface of the die wall in an accurately fitting manner. The die wall is ideally a planar surface.

The definitive fixing of the insert takes place during closing of the die. For this purpose, lugs, pins, edges and/or shielding elements (fixing elements) can be inserted in the tool side which lies opposite the insert (moveable side if the insert is positioned in the fixed side) or on slides.

If the insert is positioned in an accurately fitting manner against the wall of the impression, it is important that no casting metal should penetrate between the insert and the impression wall. This would lead to the insert being lifted off and, together with the action of forces of the fixing elements, would lead to bending moments which would destroy the insert. This can be prevented if, for example, the contact surface between the insert and the impression wall is sealed by edges of the opposite mould side.

In various components, it is necessary for the inserts to be positioned freely in the chamber of the impression. In this case, the fixing is likewise provided by fixing elements. After the impression has been completely filled, the infiltration of the insert takes place uniformly from all sides, i.e. isostatically. Isostatic infiltration has the advantage that the bending moments which act on the insert are reduced to a minimum.

As an alternative and/or to assist the externally acting fixing elements, it is possible to provide the insert with bores and to position it accurately on pins which are located on the fixed side or the moveable side or on a slide. This is advantageous if the design of the component which is to be produced does not locally allow any fixing elements, which are reflected as cavities in the component, to be present in the impression.

The cross section of a casting plunger which delivers the casting metal is generally larger than the cross section of the opening of the impression (gate). The result is that the casting metal is accelerated when it enters the impression at a constant casting-plunger velocity. To protect the insert from the casting metal, it is expedient, in addition to the shielding elements, to maintain a low velocity of the casting metal. In practice, it has emerged that the velocity of the casting metal in the region of the insert should be no greater than eight times the maximum casting-plunger velocity. Therefore, the cross section of the gate should be no less than approximately one eighth of the cross section of the casting plunger.

Components of internal-combustion engines and transmissions are particularly suitable for local reinforcement of light-metal components using the device according to the invention. In these components, very high demands are imposed on the properties of the materials used. Properties which should be mentioned are the bending strength, the modulus of elasticity, the coefficient of expansion and the resistance to wear. Local reinforcements are employed in particular in cylinder liners used in the cylinder crankcase. In cylinder liners, firstly the wear resistance and secondly the rigidity of the liner are of importance. This is particularly important with small cylinder spacings, i.e. a narrow web width, since in this case, without reinforcement, there is undesirable bulging of the liner, which leads to a gap forming between cylinder and liner, through which unburnt fuel can escape (blow-by effect).

Base bearing regions of a crankshaft (e.g. in the cylinder crankcase and/or in the crankcase lower half and/or in the bearing cap) and bearing regions in gear casings represent a further application for local reinforcements. In this case, the increased rigidity of the reinforcement element and the lower coefficient of expansion and the higher resistance to creep compared to the unreinforced light metal can be exploited. On account of the good resistance to wear of the reinforcing elements, it is conceivable that they could also replace the bearing shells in the bearing block.

Further, mechanically loaded components or functional elements which can be reinforced by reinforcing elements are, for example, collecting rods, turbocharger blades or sliding blocks on a transmission shifting fork. Furthermore, brake discs can be reinforced in the region of the friction ring, making use of the resistance to wear of the reinforcing element, which is higher than that of the light metal.

Furthermore, by controlled selection of the starting composition of the insert, it is possible, by applying the device according to the invention, to produce a component in the form of a heat sink with a low coefficient of expansion combined, at the same time, with a high thermal conductivity.

The division of the casting operation into three phases, namely the preliminary section, the filling movement and the recompacting, which is customary in standard pressure die-casting, is employed in modified form in the process according to the invention as described in a preferred embodiment. The three phases are defined by the velocity of the casting plunger as a function of the extent to which the die is filled with the casting metal. A characteristic of standard pressure die-casting is that the casting plunger is moved slowly until the casting metal reaches the impression (preliminary section), and then for the casting plunger to be accelerated (filling movement). However, if there is a porous insert in the impression, it is advantageous for the casting plunger only to be accelerated when the insert has already been surrounded by the casting metal. This prevents damage to the insert and reduces the scrap rate. The extent of filling of the impression when the filling movement commences is dependent on the position of the insert in the component and may be between 10% and 90% in practice, it has proven particularly expedient for the impression to be between 50% and 80% full at the start of the filling movement.

The infiltration of the porous ceramic insert with the casting metal leads to the formation of a penetration structure. This means that the open pores of the insert which are connected to one another via passages are filled by the casting metal. Accordingly, each material phase forms its own three-dimensional framework, and the two frameworks are interwoven with one another in such a manner that a compact body is formed, namely the reinforcing element. One advantage of this type of reinforcing elements over monolithic reinforcing elements, for example made from grey cast iron, consists, in addition to the weight saving, in the fact that there is no defined boundary between the material of the component and the material of the reinforcing element. Rather, the metal of the component is identical to the metal of the reinforcing element and is continuously joined thereto.

Different demands are imposed on the properties of the reinforcing element, and therefore it is expedient, within the context of the invention, to use different raw ceramic powders as precursor products of the insert for different applications. For example, if a high hardness or wear resistance is required, it is advantageous to use titanium carbide or silicon carbide as the raw powder. In the case of components which have to have a high thermal conductivity, silicon carbide or aluminum nitride is a suitable raw ceramic powder. In many cases, the mechanical properties such as strength, modulus of elasticity, resistance to creep or wear resistance are of importance, taking account of the raw-material costs, for the mode of action of the reinforcing element. Depending on these criteria, raw powders such as titanium oxide, spinel, mullite, aluminum silicates or clay minerals are used.

The use of fibers in composite materials generally increases the ductility of a composite material. This stems from the fact that the fibers absorb the energy of cracks, and therefore the composite material has a higher fracture resistance. In this case, the bonding between the fiber and the matrix is particularly important. It has emerged that in the process according to the invention, particularly high fracture resistances are achieved by metal fibers, in particular those based on iron, chromium, aluminum and yttrium. The most favorable thickness for the fibers is in a range between 20 $\mu$m and 200 $\mu$m, in particular between 35 $\mu$m and 50 $\mu$m.

Depending on the degree of filling of the die, the velocity of the casting plunger is an important parameter for the process according to the invention. It has emerged that the velocity of the casting plunger during the preliminary section is advantageously between 0.1 m/s and 2 m/s. The velocity of the casting plunger may increase within this range during the preliminary section if this is appropriate for the filling operation. The velocity of the casting plunger during the filling movement is, according to the invention, between 1 m/s and 5 m/s, so that a low velocity in the preliminary section is linked to a low velocity during the filling movement. The optimum velocities are in each case dependent on the geometry of the impression and are accordingly specific to the die. In general, it should be ensured that the lowest possible casting-plunger velocity within the indicated range, which ensures that the component is produced without defects, is selected during the preliminary section. The filling movement should be carried out with the highest possible velocity within the indicated range. The optimum velocities within the ranges described must be determined separately for every component geometry.

The pressure of recompacting results from the velocity of the casting plunger during the filling movement and from the casting-plunger displacement during the filling movement. When using the process according to the invention, the filling movement starts later than in the conventional pressure die-casting process, and accordingly the maximum pressure achieved during the recompacting is lower than in the conventional pressure die-casting process. It is generally between 600 bar and 1200 bar, in most cases between 700 bar and 900 bar; the highest possible pressure should be aimed for in order to achieve good infiltration.

In the process according to the invention, particularly when using aluminum or magnesium alloys, the temperature of the casting metal is between 680° C. and 780° C. The temperature should be selected to be as high as possible, so that during the filling of the impression and in particular during the infiltration of the insert the casting metal remains sufficiently hot for its temperature to be above the liquidus temperature, i.e. remains in liquid form and no solidification commences, which could cause the pores of the insert to become blocked. If the casting metal consists of an aluminum alloy, at temperatures of over 740° C. the metal takes up hydrogen from the air, which has an adverse effect on the quality of the component which is to be cast therefrom. For this reason, the optimum temperature of the casting metal is between 700° C. and 740° C.

Also in order to prevent solidification of the casting metal prior to infiltration, it is advantageous to preheat the insert at a temperature of between 500° C. and 800° C. A preheating temperature which is between 600° C. and 700° C. is particularly advantageous, since this prevents the possibility of a chemical reaction between the casting metal and the insert and, at the same time, delays solidification of the casting metal.

The preheating of the insert may take place in an electrically heated chamber furnace, which is expedient when producing components in small numbers. However, when using series production, a continuous furnace is particularly suitable. This ensures a continuous supply of the inserts required for production and, moreover, allows a constant temperature of the inserts to be established. As the process sequence continues, the inserts can be picked up by a casting robot and placed into the die. This saves time over manual insertion and ensures that the insert is positioned accurately in the die.

For application of the process according to the invention, it is particularly advantageous for the casting metal used to be aluminum or magnesium or alloys of these metals. These metals have a low density and are particularly suitable for casting using the pressure die-casting process.

The insert is infiltrated particularly well by the casting metal if it has a porosity of between 30% and 80%, and very good infiltration can be achieved in particular at a porosity of 50%, the insert having a relatively high strength. The optimum pore diameter of the insert is between 1 $\mu$m and 100 $\mu$m, preferably is 20 $\mu$m.

In the text which follows, the invention is explained in more detail with reference to six exemplary embodiments which are illustrated in the following drawings, in which:

DETAILED DESCRIPTION OF THE DRAWINGS

Figure 1:
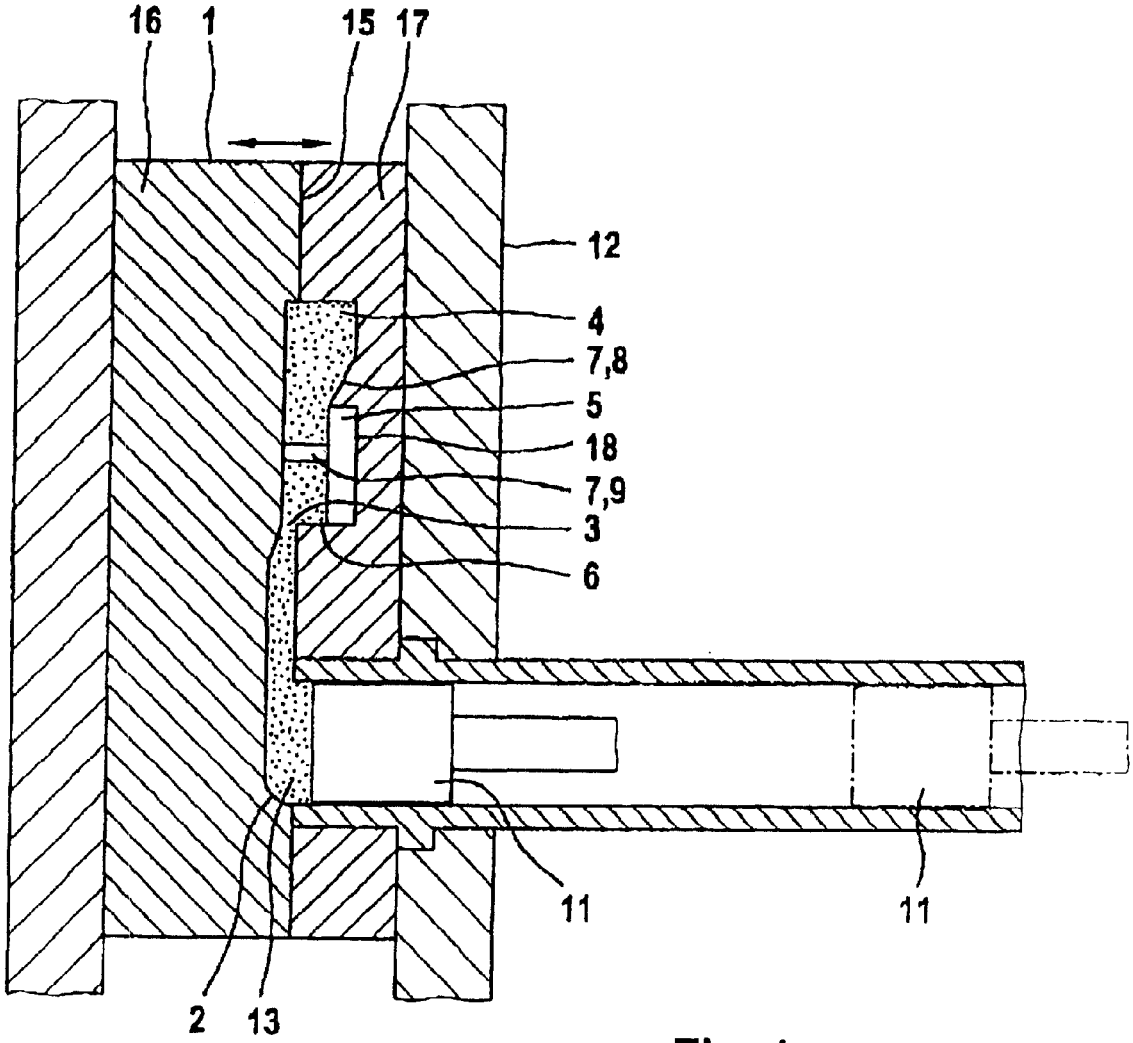
FIG. 1 shows a first example of an outline illustration of a pressure die-casting machine, with a die illustrated in section, having an insert and a casting plunger.

FIG. 1 shows an outline view of a casting machine 12 having a die 1 which comprises a runner 2, a gate 3 of defined cross section and an impression 4, with a device for positioning the insert 5 by means of fixing elements 7. Furthermore, the die 1 comprises two parts which, when ready for casting, are in contact with one another in a parting plane 15. One of these parts is a fixed side 16, which remains in a stationary position with respect to the casting machine 12 when the die 1 is opened, while the other part comprises a moveable side 17, which moves in the direction of the arrow with respect to the casting machine 12 when the die 1 is opened.

The die is attached to a casting machine 12 which comprises a casting plunger 11 of defined cross section, which forces the casting metal 13 into the runner 2 with a defined velocity and, as it continues through the gate 3, into the impression 4 of the die 1.

For optimum filling of the die 1 with the casting metal 13, it is necessary for the casting metal 13 to be able to reach all regions of the impression 4 without being impeded. Its kinetic energy means that the casting metal 13 exerts a force on the insert 5, and this force may lead to bending moments which may exceed the strength of the insert 5. For this reason, according to the invention, the insert 5 is protected from the casting metal 13 by shielding elements 6, so that the casting metal 13 flows laterally around the insert 5. In this way, the action of forces on the insert 5 is reduced.

FIG. 1 shows the shielding element 6 in the form of a wall of the impression 4. To further reduce the forces acting on the insert 5, it is necessary for the insert 5 to be fixed in such a way that the forces acting as a result of the fixing cause the lowest possible bending moments, and according to the invention this is achieved by the fact that a collinear force substantially counteracts forces occurring on the insert 5 by means of the fixing elements, i.e. the two forces lie on one straight line.

In FIG. 1, the insert 5 is fixed in one direction by a lug 8 and the lower wall of the impression 4, which simultaneously functions as shielding element 6. Perpendicular thereto, the insert 5 is fixed by a pin 9 and the lateral wall 18 of the impression 4. In both of the directions, the force lines of the forces acting on the insert lie on a straight line. The straight lines on which the force lines of the collinear forces lie may be at any desired spatial angle with respect to one another.

When positioning the insert 5 in the die 1, the design should make sure to use contours of the impression, which serve to form the component geometry, as shielding elements, as illustrated in FIG. 1. If this option does not exist, for design reasons, shielding elements as shown in FIG. 2 and in FIG. 3 are used.

Figure 2:
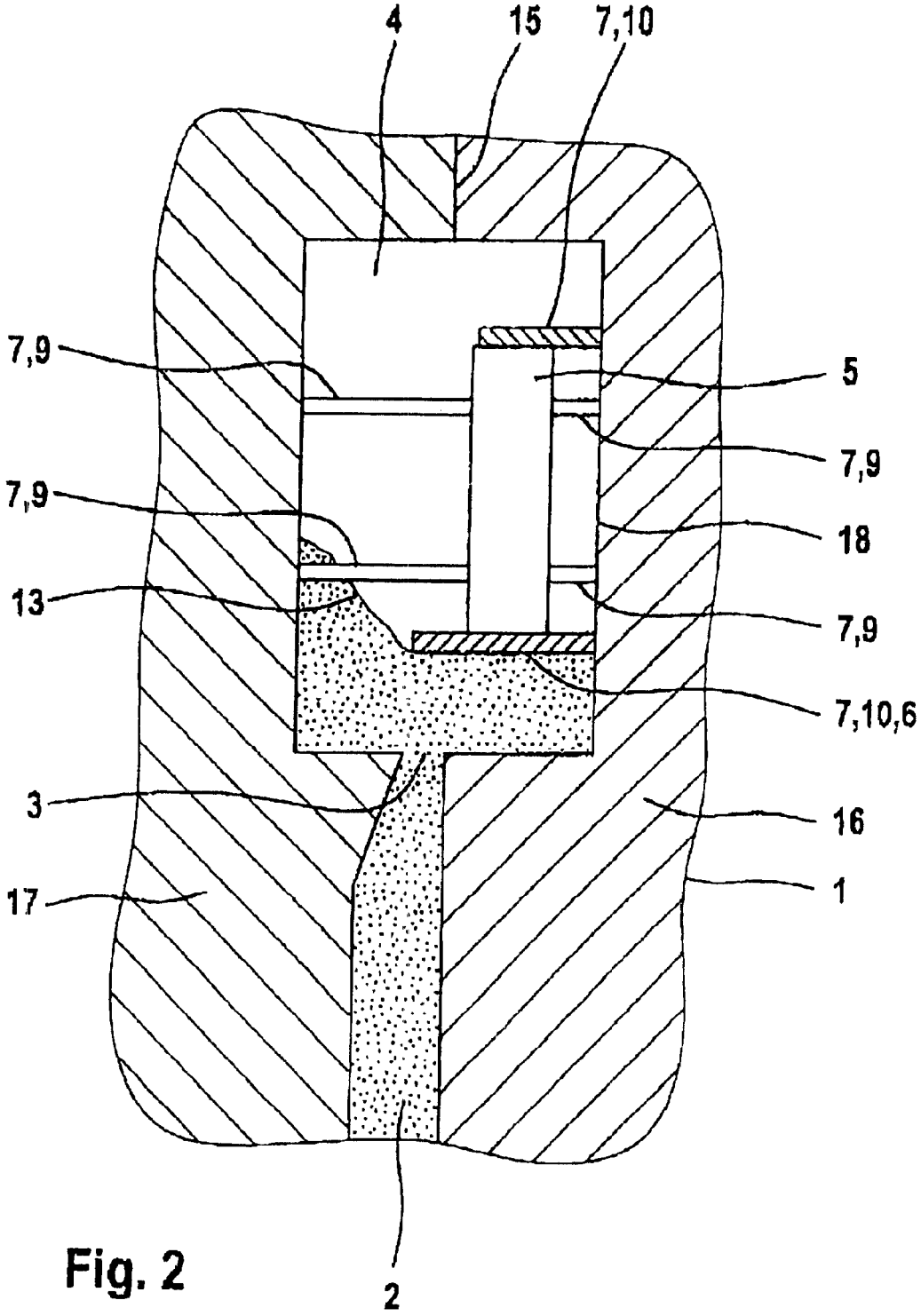
FIG. 2 shows a second example illustrating an enlarged sectional view of a detail of the die, with an insert, fixing elements and shielding element arranged therein.

In a further example, as shown in FIG. 2, a rectangular insert 5 is fixed from below by a shielding element 6, which in this example is designed in the form of an edge 10. On the opposite side, the fixing takes place, taking account of the collinearity of the forces, likewise by means of an edge 10. The horizontal fixing of the insert is effected by pins 9.

Figure 3:
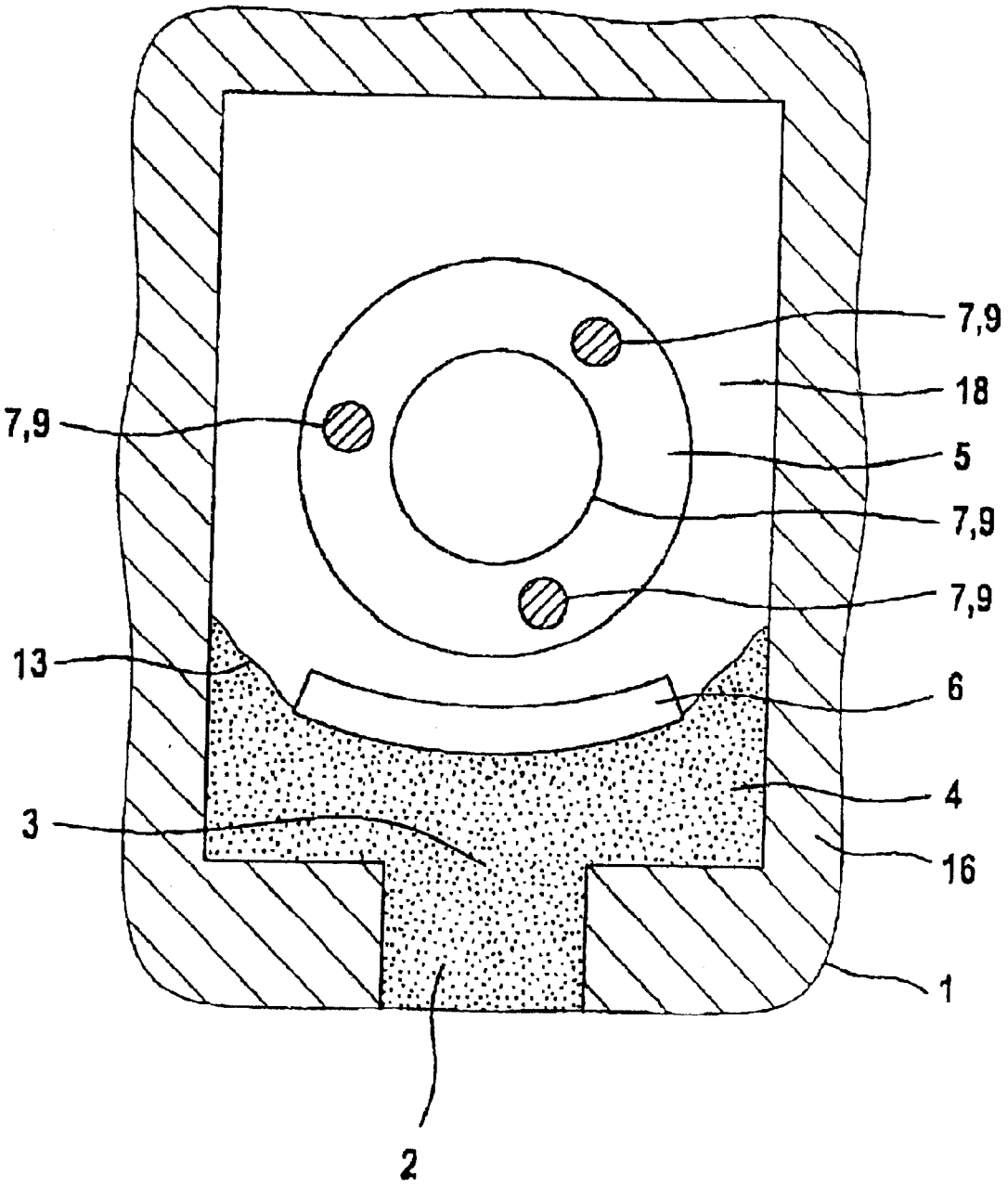
FIG. 3 shows a third example illustrating an enlarged sectional view of a detail of a die, having an insert, fixing elements and shielding element.

FIG. 3 shows a further example, illustrating an annular insert 5 which in the fixed side 16 of the die 1 has been pushed onto a pin 9 and is pressed against the wall 18 of the impression 4 on the fixed side 16 by further pins 9 which are arranged in the moveable side 17. The runner 2 is situated directly below the insert, and when the casting metal 13 enters the impression 4 it is guided past the insert 5 by the shielding element 6.

Figure 4:
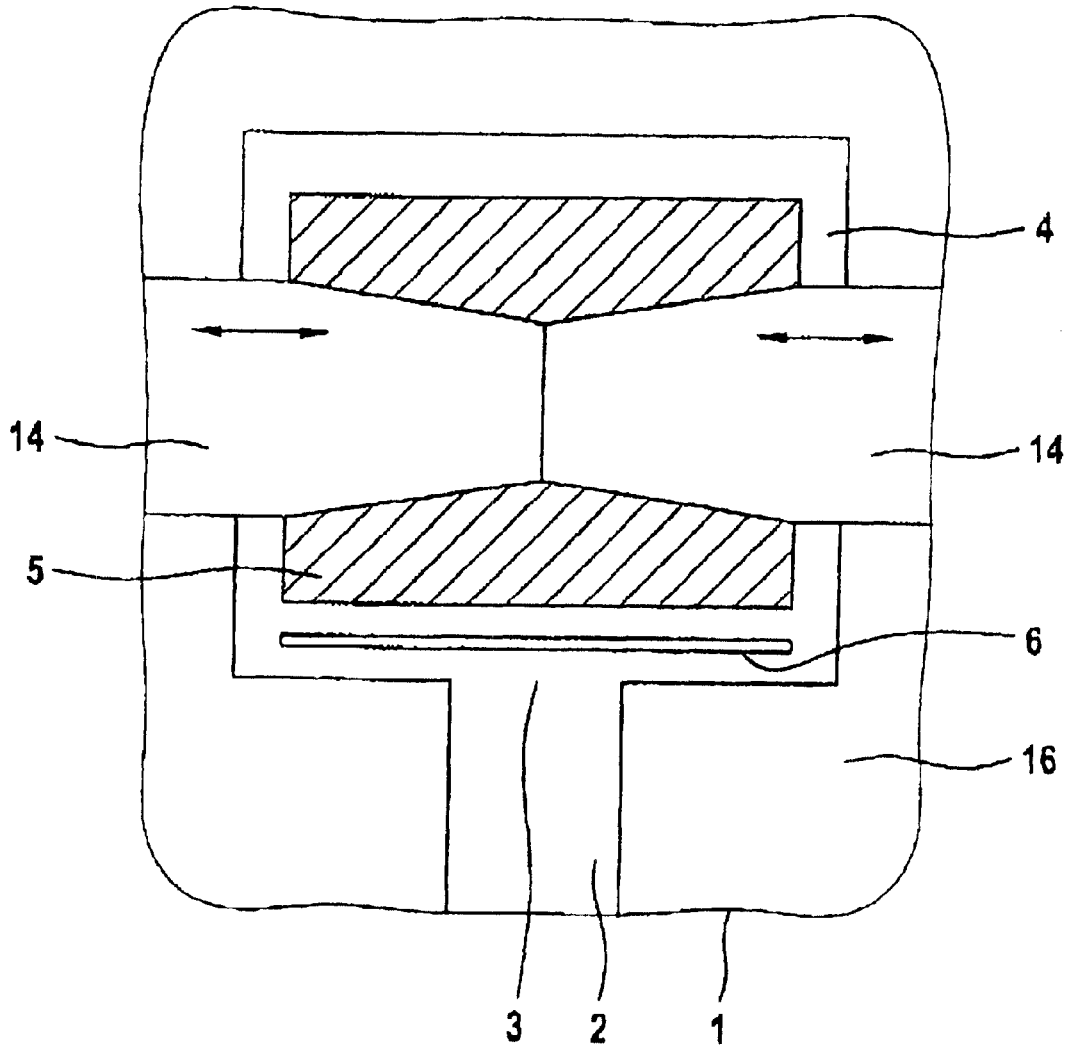
FIG. 4 shows a fourth example illustrating an enlarged sectional view of a detail of a die in which a shielding element and an insert, which is positioned on a slide of the die, are shown.

FIG. 4 shows a further exemplary embodiment according to the invention, in which the parting plane of the fixed side 16 is shown. A cylindrical insert 5 has been fitted onto two conical slides 14. The slides are either attached to the fixed side 16 or are attached to the moveable side 17, and can be retracted from the impression 4 sufficiently far for it to be possible to remove the component from the die. The moveable side and the fixed side are in contact with one another in a positively locking manner in the parting plane 15 and can be separated in order to remove the component from the die. The shielding element 6 is situated beneath the insert 5 and, in this example, is of two-part design, one part being situated in the fixed side 16 and the other part in the moveable side 17. The principle of the exemplary embodiment shown in FIG. 4 is suitable for forming a liner in a cylinder crankcase as a reinforcing element. It is possible to use only one slide, onto which the insert is fitted over its entire length.

Figure 5:
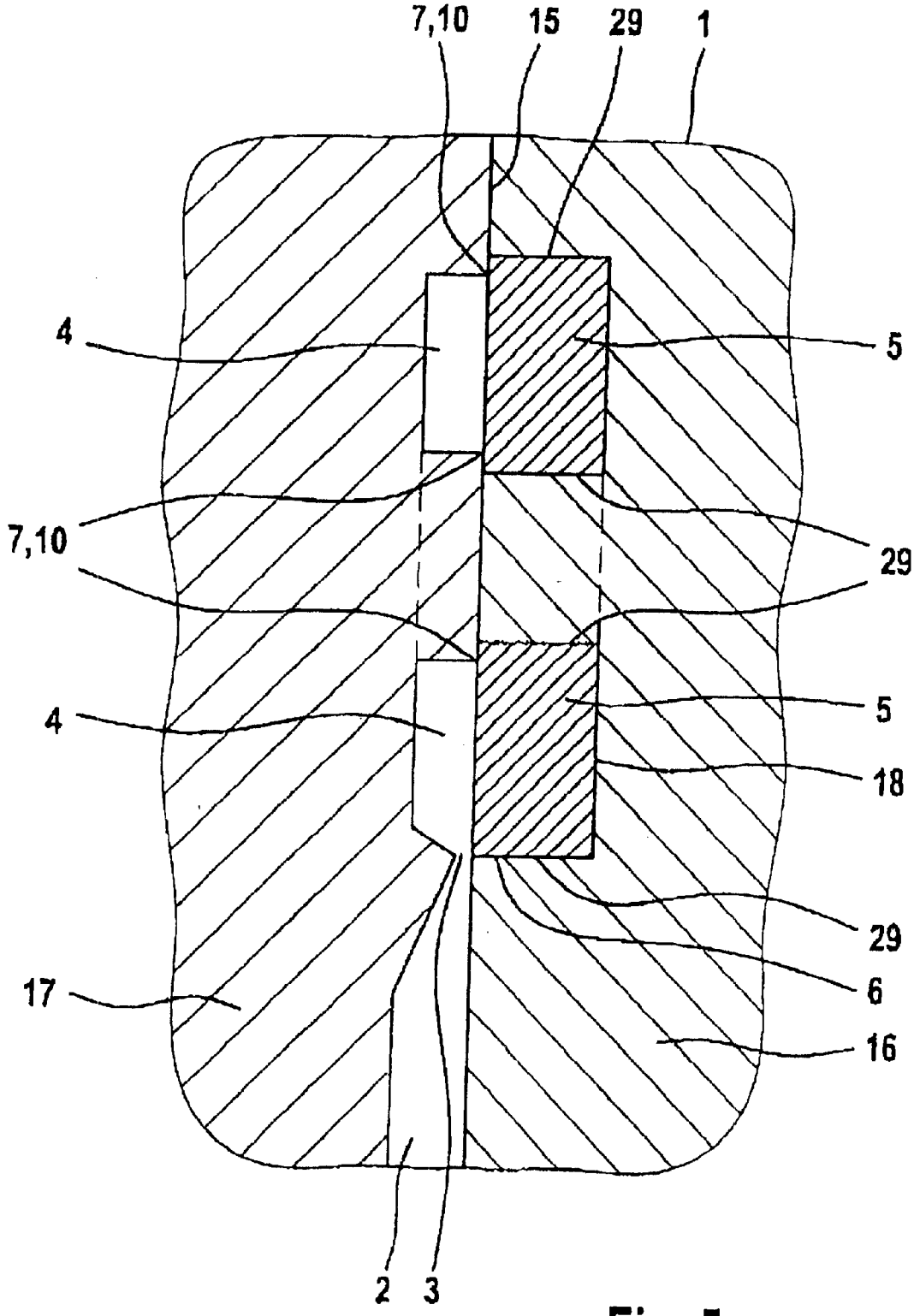
FIG. 5 shows a fifth example of an enlarged sectional drawing of a detail of a die with an annular insert and fixing elements.

FIG. 5 shows an annular insert 5 which is positioned in the fixed side 16. The impression 4 of the fixed side 16 and the insert 5 are of congruent design, so that there is no play within the manufacturing tolerances. However, the liquid casting metal is able to penetrate through small gaps (>0.1 mm). When using porous ceramic inserts, it is only possible to guarantee tolerances of <0.1 mm with a high level of outlay, and this is true in particular if it is taken into account that the impression has bevels for removing the component from the die on the surfaces 29 which face the parting plane. Accordingly, in principle it is possible for casting metal to reach between the surfaces 29 and the insert 5 (which would lead to bending moments) under the said conditions. This is prevented by the edge 10 of the moveable side 17, which edge 10 at the same time functions as a fixing element. In FIG. 5, the insert is positioned in such a way that the surface 29 of the impression 4 which faces the parting plane serves as a shielding element 6.

Figure 6:
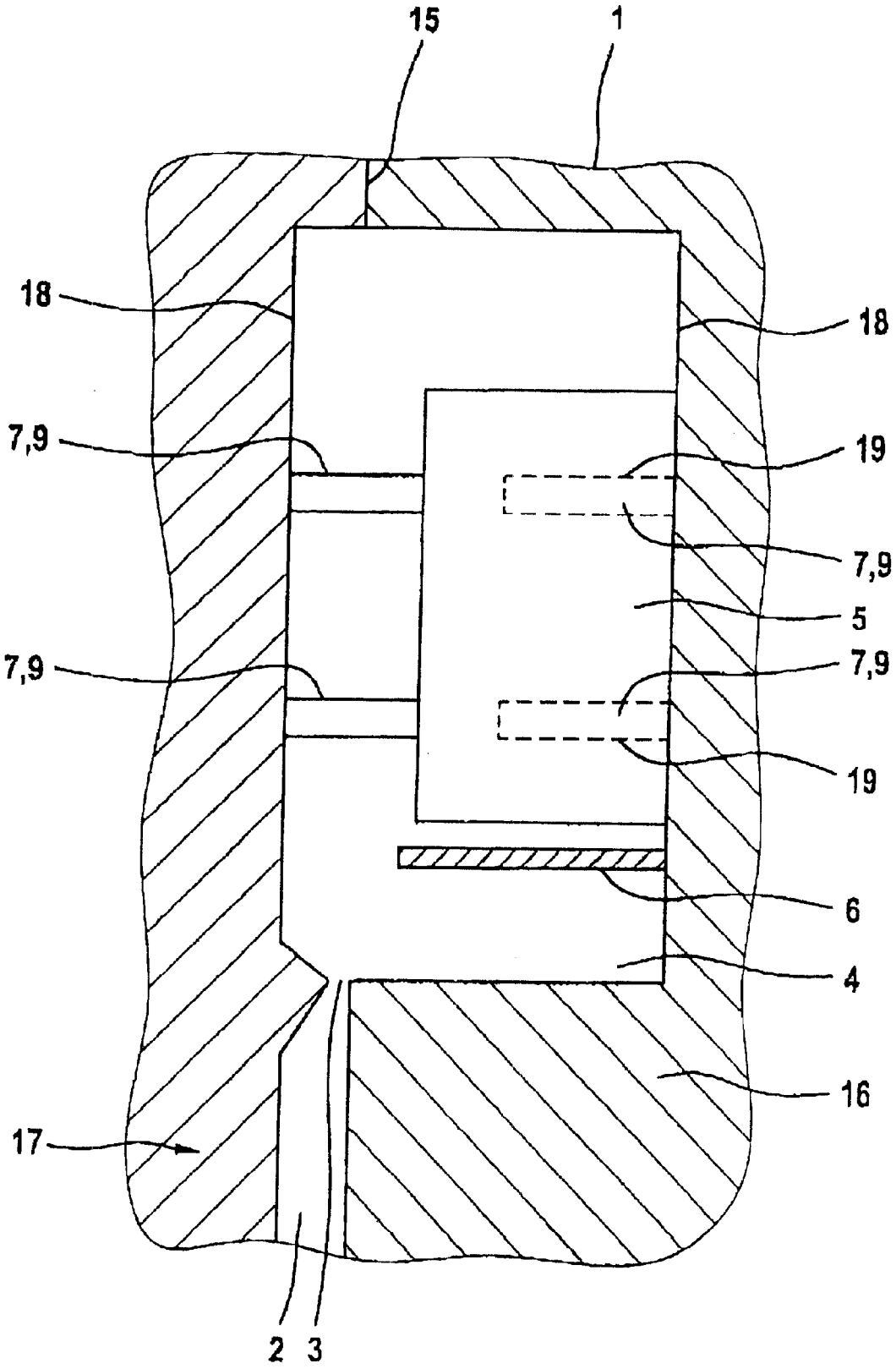
FIG. 6 shows a sixth example of an enlarged sectional illustration of a detail of a die, having an insert in which there are bores and which has been fitted onto fixing elements of the die.

FIG. 6 shows a sectional view of the impression 4, in which an insert 5 provided with bores 19 has been fitted onto pins 9 which are secured in the fixed side 16 of the die. Further pins 9 are secured in the moveable side 17 and fix the insert 5, ensuring the collinearity of the forces acting on the insert 5. Fixing of the insert 5 as shown in FIG. 6 is expedient if component geometry stipulations mean that external fixing elements are not acceptable at certain locations. The pins 9 on the moveable side 17 which are shown in FIG. 5 may also, according to the invention, be formed by edges or lugs. Furthermore, it is possible to design the impression 4 in such a way that the impression wall 18 of the moveable side 17 bears directly against the insert 5 and fixes the latter. In this example, the shielding element 6 is arranged beneath the insert 5, in such a way that it does not touch the latter.

Figure 7A:
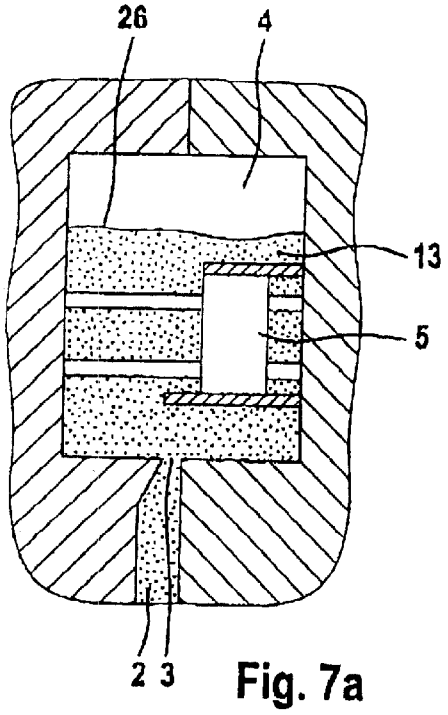
FIGS. 7*a*, 7*b* and 7*c* show a diagrammatic profile of the way in which an impression is filled with a casting metal.
Figure 7B:
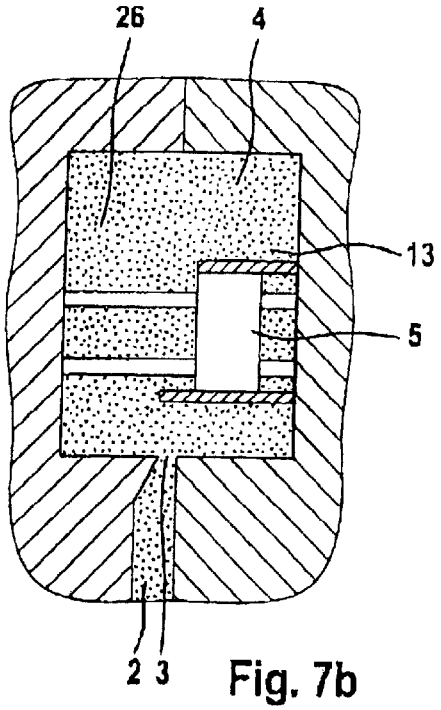
Figure 7C:
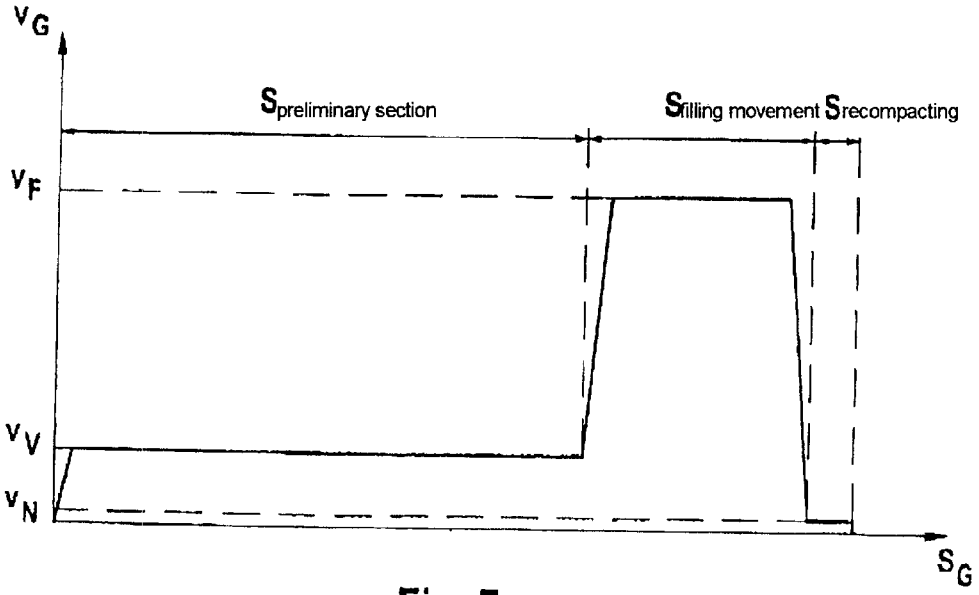

The text which follows describes the process according to the invention, which is illustrated by FIGS. 7*a*–7*c*.

In terms of time, the conventional pressure die-casting operation is divided into three phases. In a first phase, the casting plunger 11 (cf. FIG. 1) moves at a constant velocity until the runner 2 of the die 1 is filled with casting metal 13 (preliminary section). In a second phase, the filling movement, the casting plunger 11 is accelerated and the impression 4 is filled with casting metal 13. In a third phase, the casting plunger 11 is suddenly decelerated, since the entire die 1 has been filled with casting metal 13, and at the same time a pressure, which may amount to up to 1200 bar, is built up on the casting metal 13 in the die 1 (recompacting). The recompacting prevents shrinkage of the component through solidification of the casting metal 13, and at the same time, in the process according to the invention, the pressure of the casting metal 13 is used for infiltration of the insert 5.

Depending on the design of the die 1, the velocity of the casting metal 13 during the filling movement may be up to ten times as high as the velocity in the preliminary section. The filling-movement velocity in the gate 3 is usually between 30 m/s and 50 m/s. The velocity of the casting metal in the gate $v_A$ is generally calculated using the following formula:

$$v_A = \frac{S_G \cdot v_G}{S_A}$$

where $S_G$=Cross section of the casting plunger [$m^2$]

$v_G$=Velocity of the casting plunger [m/s]

$S_A$=Cross section of the gate [$m^2$]

$v_A$=Velocity of the casting metal at the gate [m/s]

The kinetic energy which the casting metal 13 possesses in the process may cause damage to the insert 5. To. prevent this, according to the invention, the preliminary section involves filling at a low velocity of the casting plunger $v_V$ (0.1 m/s–1.5 m/s) until the insert 5 has already been surrounded by casting metal. The filling level 26 of the impression 4 is, for example, approx. 80% (FIG. 7*a*). Then, the casting plunger 11 is accelerated during the filling movement and the impression is filled to a 100% with casting metal at a higher velocity of the casting plunger $v_F$ (1 m/s–5 m/s) (FIG. 7*b*). FIG. 7*c* shows the velocity of the casting plunger 11 $v_G$ as a function of the distance $S_G$ covered by the casting plunger. The first travel of the preliminary section $S_V$ takes place at the low velocity $V_V$ until the filling level of the impression 26 which is shown in FIG. 7*a*. Then, the casting plunger 11 is accelerated to the velocity $v_F$, which is maintained over the distance of the filling movement $S_F$, until the impression is completely full (FIG. 7*b*). Then, the casting plunger 11 is abruptly decelerated (recompacting), the velocity drops to $v_N$, with the casting plunger 11 moving only slightly further for recompacting of the casting metal $S_N$. In this recompacting phase, the insert is infiltrated with the casting metal, which leads to the movement of the casting plunger 11 $S_N$.

The filling level 26 at the start of the filling movement is dependent on the position of the insert 5 in the impression 4 and on the geometry of the component and is between 10% and 90%. The insert 5 would experience the lowest possible load if there were to be no acceleration during the filling movement. However, this would be unable to ensure optimum filling of the impression 4 with the casting metal 13. The optimum filling of the impression 4 and the mechanical load-bearing capacity of the insert 5 are two criteria which are directly but oppositely influenced by the velocity of the casting metal 13 during the filling movement. To be able to fulfil both criteria, in practice a filling level of between 50% and 80% has proven appropriate.

Figure 8:
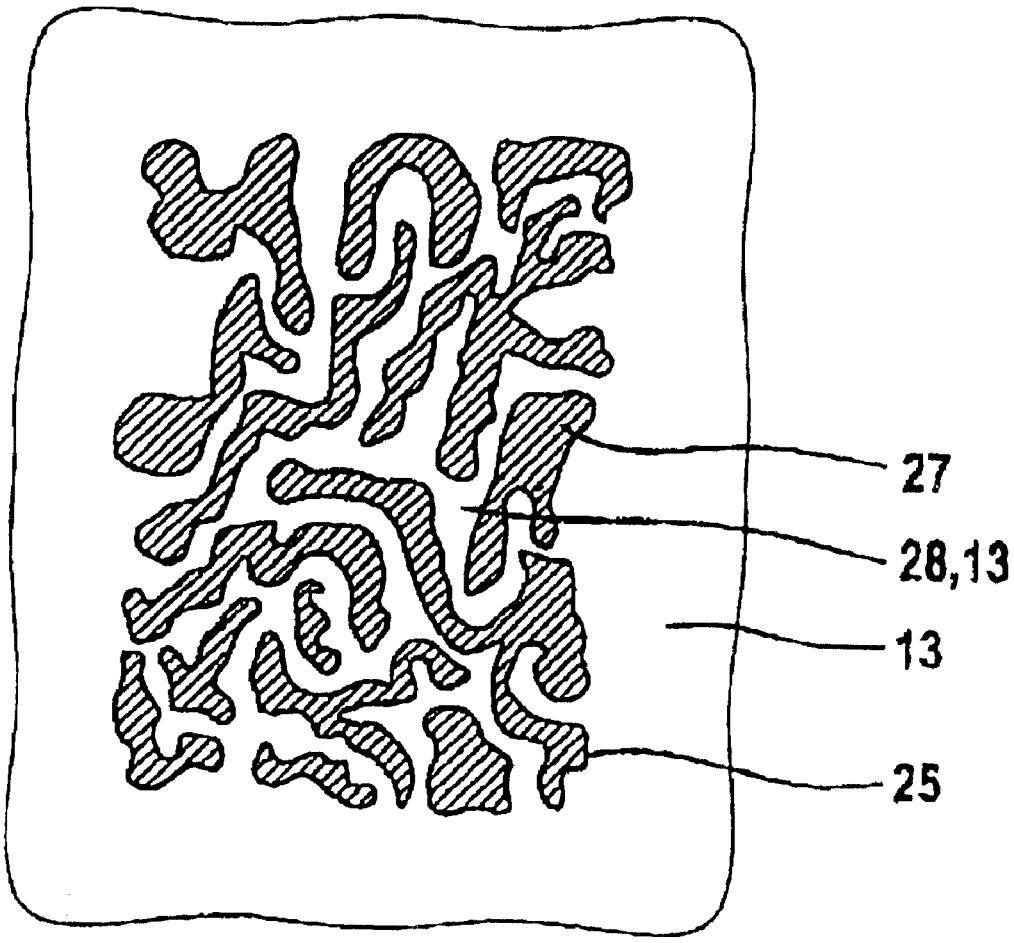
FIG. 8 shows a penetration structure with a metallic material phase and a ceramic material phase.

FIG. 8 shows an enlarged diagrammatic illustration of a penetration structure of the reinforcing element 25. The ceramic material phase 27 of the reinforcing element 25 is three-dimensionally linked and has an open pore system which is completely filled up by the infiltrated casting metal, the metallic material phase 28. The metal which is present in the penetration structure is identical to the solidified casting metal which formed the component and is continuously joined to the latter in a transition layer. Together, the two material phases form a dense and pore-free penetration structure.

In the text which follows, the present invention is explained in more detail with reference to exemplary embodiments relating to the process.

EXAMPLE 1

1. Production of the Insert

To prepare the powder, 95% by weight of $TiO_2$ as ceramic powder and 5% by weight of carbon powder were mixed with 15% by weight (based on the ceramic-carbon mixture) of PEG powder as binder in a star rotor mixer for 15*s* at level II and for 1 min at level I. The resulting mixture had a bulk density of 0.750 g/cm$^3$. 3% by weight (based on this mixture) of water was added, and mixing continued in the star rotor mixer for 15 *s* at level II and 1 min at level I.

The resulting powder then had a bulk density of 0.942 g/cm$^3$.

To recycle the powder, a powder of the above composition was mixed in a star rotor mixer for 5 min at level II. The powder then had a bulk density of 1.315 g/cm$^3$.

This powder with a bulk density of 0.942 g/cm$^3$ or 1.315 g/cm$^3$ was added cold to a press mould which was heated at 75° C. Air pockets were removed. The press was closed under a vacuum and underwent stress-relief for 5 min at 300 and 600 N. Then, uniaxial pressing under vacuum was carried out for 2 min under a compression force of 1500 KN. The press was opened slowly. The result was a powder preform which had been compressed to near net shape and was dried at 60° C. in the drying furnace and then remachined to its final dimensions. It may optionally also undergo cold isostatic pressing after the drying and before the final machining.

To fire out the organic constituents ("debinding"), the dried powder preform was heated in a tunnel furnace with air being admitted to 100° C. over the course of 60 min and was heated at this temperature for 90 min., followed by further temperature ramps, to 400° C. over 300 min and to 550° C. over a further 60 min. At this point, further heating of the powder preform to up to 1150° C. is possible, which contributes to improving its strength. The cold powder preform, which had been treated at a temperature of 550° C., then had a compressive strength of approx. 15 MPa, a bending strength of 3 MPa and a porosity of approx. 45%. Powder preforms which had been annealed for 1 h at 1150° C. had a bending strength of 30 MPa and a porosity of 35%. Powder preforms which had been produced and machined in accordance with the process described are referred to as inserts in the text which follows.

2. Pressure Infiltration

The porous ceramic insert 5 was preheated to a temperature of 500° C., in order to prevent premature cooling of the casting metal by the insert. Then, it was placed at a defined position in a die and was fixed in accordance with the invention. Then, the die was closed and the impression was filled with aluminum or an aluminum alloy in order to form the overall component. By way of example, 99.9% pure aluminum or all aluminum alloys which are suitable for pressure die-casting (for example GD 226 or GD 231) can be used for this purpose. In detail, during the casting process the temperature of the die was set at 300° C. The specific pressure of the casting metal was between 600 and 800 bar, and the temperature was approximately 680 to 750C. The build-up of pressure during the filling movement took place after the die was 60% full. The duration of the filling of the die was 100 ms for a plunger velocity of approximately 0.2 m/s (preliminary section) to 1.8 m/s (filling movement). The time for which the die was held closed was approximately 10 s to 40 s. In this exemplary embodiment, a die-cast aluminum component with a reinforcing element made from titanium oxide and aluminum having a bending strength of 400 MPa, a thermal conductivity of approximately 60 W/mK and a density of approximately 3.1 g/cm$^3$ was obtained.

During the filling of the die, the insert is infiltrated with the aluminum alloy AlSi9Cu3 (GD 226) and, at the same time, the remaining intervening regions in the die which do not have an insert were filled with the metal. In the process, a component which is to be produced can be appropriately adapted to its intended purpose. For example, it is possible to produce a cylinder crankcase with reinforced webs between the cylinder liners, in which case inserts which had been suitably formed near net shape are positioned according to the invention in the die in the region of what subsequently form the webs. The remaining empty regions of the die, which surround the subsequent crankcase, then form the intervening regions.

The filling of the die or the infiltration of the insert takes place at a filling temperature which lies above the liquidus temperature of the casting metal but is sufficiently low for there to be no reaction with the ceramic insert. Particularly when using aluminum as the filling metal, the filling temperature is less than 750° C. When producing brake discs, the resulting brake disc, after the filling, can be heated in the region of the frictional surfaces of the subsequent friction ring in a manner known per se, at or above a reaction temperature at which an intermetallic-ceramic composite material is formed. Therefore, with regard to the brake disc, the heating takes place selectively. It can be effected by induction or laser heating. The introduction of energy can be controlled in such a way that a gradient results, the ceramic-metal composite material of the reinforcing element merging seamlessly into the intermetallic-ceramic composite material.

EXAMPLE 2

In a similar way to Example 1, a porous ceramic insert was produced using AlN as ceramic powder and was infiltrated with aluminum under the same conditions. The die produced a heat sink for power electronics. The ceramic matrix reinforces the upper region of the heat sink, so that the coefficient of expansion between electronic substrate and heat sink was matched while at the same time achieving a high thermal conductivity.

EXAMPLE 3

In a similar manner to Example 2, a porous ceramic insert was produced using SiC as raw powder and was infiltrated with aluminum under the same conditions.

EXAMPLE 4

A porous ceramic insert was produced in a similar manner to Example 1, using $TiO_2$ as the ceramic powder, and was infiltrated with a magnesium alloy (AZ 91) under the same conditions.

EXAMPLE 5

In a similar manner to Example 1, a porous ceramic insert was produced, using $TiO_2$ as ceramic powder. In this case, 30% by volume (based on the overall powder volume) of reinforcing carbon fibers in the form of short fibers with a length of from 3 to 15 mm were added to the mixture. The porous ceramic insert was infiltrated with aluminum under the same conditions.

EXAMPLE 6

In a similar manner to Example 1, a porous ceramic insert was produced, using $TiO_2$ as the ceramic powder. The insert underwent cold isostatic pressing in the form of a cylinder and was infiltrated with aluminum under the same conditions. The resulting component is a cylinder crankcase with a cylinder liner formed by a reinforcing element.

What is claimed is:

1. A die having a fixing means and an insert for production of a component which is locally reinforced by the insert, comprising shielding elements, by which the insert is shielded from a propagation flow of a casting metal during a casting operation, wherein the insert is a porous ceramic insert, which has a porosity of between 30% and 80%, and is suitable for infiltration with a casting metal, and wherein the die is a positive pressure die-casting die which has fixing elements for positioning the insert, by which the forces acting on the insert can be compensated for by corresponding collinear forces.

2. A die according to claim 1, wherein the insert can be positioned in one of a fixed side of the die, a moveable side of the die and a slide of the die.

3. A die according to claim 1, wherein the insert bears in a closely fitting manner against a wall of an impression.

4. A die according to claim 2, wherein the insert bears in a closely fitting manner against a wall of an impression.

5. A die according to claim 1, wherein the final positioning and fixing of the insert in the die takes place when the die is closed.

6. A die according to claim 2, wherein final positioning and fixing of the insert in the die takes place when the die is closed.

7. A die according to claim 3, wherein final positioning and fixing of the insert in the die takes place when the die is closed.

8. A die according to claim 1, wherein a transition between the insert and a wall of the impression which adjoins the insert can be sealed with respect to the casting metal by edges of corresponding parts of the die or by a slide.

9. A die according to claim 2, wherein a transition between the insert and a wall of the impression which adjoins the insert can be sealed with respect to the casting metal by edges of corresponding parts of the die or by a slide.

10. A die according to claim 3, wherein a transition between the insert and a wall of the impression which adjoins the insert can be sealed with respect to the casting metal by edges of corresponding parts of the die or by a slide.

11. A die according to claim 5, wherein a transition between the insert and a wall of the impression which adjoins the insert can be sealed with respect to the casting metal by edges of corresponding parts of the die or by a slide.

12. A die according to claim 1, wherein the insert is positioned freely in a chamber of the die and is held by one of pins, lugs and edges, allowing isostatic infiltration from all sides.

13. A die according to claim 2, wherein the insert is positioned freely in a chamber of the die and is held by one of pins, lugs and edges, allowing isostatic infiltration from all sides.

14. A die according to claim 1, wherein the insert is provided with bores and can be fitted onto pins of the die.

15. A die according to claim 2, wherein the insert is provided with bores and can be fitted onto pins of the die.

16. A die according to claim 3, wherein the insert is provided with bores and can be fitted onto pins of the die.

17. A die according to claim 5, wherein the insert is provided with bores and can be fitted onto pins of the die.

18. A die according to claim 8, wherein the insert is provided with bores and can be fitted onto pins of the die.

19. A die according to claim 12, wherein the insert is provided with bores and can be fitted onto the pins of the die.

20. A die according to claim 1, wherein the die comprises a gate of defined cross-sectional area for filling an impression, and wherein the cross-sectional area is selected to be so large that a velocity of the casting metal is less than eight times a velocity of a casting plunger on entry into the impression.

21. A die according to claim 2, wherein the die comprises a gate of defined cross-sectional area for filling an impression, and wherein the cross-sectional area is selected to be so large that a velocity of the casting metal is less than eight times a velocity of a casting plunger on entry into the impression.

22. A die according to claim 3, wherein the die comprises a gate of defined cross-sectional area for filling an impression, and wherein the cross-sectional area is selected to be so large that a velocity of the casting metal is less than eight times a velocity of a casting plunger on entry into the impression.

23. A die according to claim 5, wherein the die comprises a gate of defined cross-sectional area for filling an impression, and wherein the cross-sectional area is selected to be so large that a velocity of the casting metal is less than eight times a velocity of a casting plunger on entry into the impression.

24. A die according to claim 8, wherein the die comprises a gate of defined cross-sectional area for filling an impression, and wherein the cross-sectional area is selected to be so large that a velocity of the casting metal is less than eight times a velocity of a casting plunger on entry into the impression.

25. A die according to claim 12, wherein the die comprises a gate of defined cross-sectional area for filling an impression, and wherein the cross-sectional area is selected to be so large that a velocity of the casting metal is less than eight times a velocity of a casting plunger on entry into the impression.

26. A die according to claim 14, wherein the die comprises a gate of defined cross-sectional area for filling an impression, and wherein the cross-sectional area is selected to be so large that a velocity of the casting metal is less than eight times a velocity of a casting plunger on entry into the impression.

27. a die according to claim 1, wherein the component is a functional component in one of an internal-combustion engine, a gearbox of an automobile, a brake disc and a heat sink.

28. Process for producing a component with a local reinforcing element made from a metal-ceramic composite material, comprising:

producing a porous ceramic insert with a porosity of between 30% and 80% from ceramic precursor products, locally positioning the insert in a die which has a runner, a gate and an impression, filling the die with a casting metal by a casting plunger in order to form the local reinforcing element, wherein a preliminary section comprises the filling of the runner and the filling of at least 10% of the impression with the casting metal, and a shielding element, by which the insert is shielded from a propagation flow of a casting metal during casting operation, and a velocity of the casting plunger during the preliminary section is lower than during a filling movement, the insert being infiltrated with the casting metal at elevated pressure in order to form the reinforcing element.

29. A process according to claim 20, wherein the local reinforcing element of the component comprises a ceramic material phase and a metallic material phase, each of the material phases having respective three-dimensional framework and the two material phases together being in a form of a penetration structure.

30. A process according to claim 28, wherein raw powder of the ceramic precursor product is one of $TiO_2$, $SiO_2$, TiC, SiC, spinel, mullite, aluminum silicates and clay minerals, or mixtures thereof.

31. A process according to claim 29, wherein raw powder of the ceramic precursor product is one of $TiO_2$, $SiO_2$, TiC, SiC, spinel, mullite, aluminum silicates and clay minerals, or mixtures thereof.

32. A process according to claim 28, wherein to produce the insert ceramic, metallic, mineral or carbon fibers in the form of long or short fibers, felts or woven fabrics are added to the ceramic precursor products.

33. A process according to claim 28, wherein the velocity of the casting plunger during the preliminary section is between 0.1 m/s and 2 m/s and during the filling movement is between 1 m/s and 5 m/s.

34. A process according to claim 28, wherein a maximum pressure on the casting metal is between 600 bar and 1200 bar.

35. A process according to claim 34, wherein the maximum pressure is between 700 bar and 900 bar.

36. A process according to claim 28, wherein a temperature of the casting metal of aluminum or magnesium alloys is between 680° C. and 780° C.

37. A process according to claim 36, wherein the temperature of the casting metal of the aluminum or magnesium alloys is between 700° C. and 740° C.

38. A process according to claim 28, wherein the insert is preheated to a temperature of between 500° C. and 800° C.

39. A process according to claim 38, wherein the insert is preheated to between 600° C. and 700° C.

40. A process according to claim 38, wherein the preheating of the insert takes place in a chamber furnace or in a continuous furnace.

41. A process according to claim 28, wherein the insert is placed into the die with aid of a casting robot.

42. A process according to claim 28, wherein the casting metal is one of aluminum, magnesium, an aluminum alloy and a magnesium alloy.

43. A process according to claim 28, wherein pore diameters of the insert are between 1 $\mu$m and 100 $\mu$m.

* * * * *